United States Patent [19]

Madden

[11] Patent Number: 4,563,885

[45] Date of Patent: Jan. 14, 1986

[54] PATIO SLIDING DOOR LOCK ASSEMBLY AND METHOD

[75] Inventor: Roy H. Madden, Burlington, N.C.

[73] Assignee: Excalibur Locks, Inc., Alamance County, N.C.

[21] Appl. No.: 613,763

[22] Filed: May 24, 1984

Related U.S. Application Data

[63] Continuation of Ser. No. 366,762, Apr. 8, 1982, abandoned.

[51] Int. Cl.[4] ..... E05B 65/08

[52] U.S. Cl. ..... 70/97; 70/105; 70/123; 70/210; 70/224; 70/380; 70/DIG. 42

[58] Field of Search ..... 70/95–98, 70/90, 100, 150, 209–211, 379 R, 380, DIG. 42, 135–137, 139, 105, 224, 121, 123; 292/DIG. 46

[56] References Cited

U.S. PATENT DOCUMENTS

| | | | |
|---|---|---|---|
| Re. 24,443 | 3/1958 | Labrie | 70/96 |
| 243,625 | 6/1881 | Rominger | 70/139 |
| 578,763 | 3/1897 | Nash | 70/379 R |
| 820,271 | 5/1906 | Turner | 70/100 |
| 929,637 | 7/1909 | Thomas | 70/DIG. 42 |
| 1,380,116 | 5/1921 | Solaini | 70/136 |
| 1,411,220 | 3/1922 | Meyers | 70/136 |
| 1,438,164 | 12/1922 | Andrew | 70/136 |
| 1,452,406 | 4/1923 | Arm | 70/136 |
| 1,822,278 | 9/1931 | Ellingson | 70/380 |
| 1,908,980 | 5/1933 | Heyel | 70/DIG. 42 |
| 2,129,967 | 9/1938 | Rubner | 70/379 R |
| 2,182,307 | 12/1939 | Behnke | 70/DIG. 42 |
| 2,666,319 | 1/1954 | Price | 70/97 |
| 2,738,211 | 3/1956 | Schlueter | 292/DIG. 46 |
| 2,844,020 | 7/1958 | Chittum et al. | 70/97 |
| 3,390,557 | 7/1968 | Erickson et al. | 70/97 |
| 4,313,320 | 2/1982 | Best et al. | 70/DIG. 42 X |

FOREIGN PATENT DOCUMENTS

| | | | |
|---|---|---|---|
| 574946 | 4/1959 | Canada | 70/100 |
| 1004246 | 3/1952 | France | 70/210 |
| 307915 | 6/1955 | Switzerland | 70/135 |
| 1066762 | 4/1967 | United Kingdom | 70/209 |
| 2002844 | 2/1979 | United Kingdom | 70/379 R |

*Primary Examiner*—Robert L. Wolfe
*Assistant Examiner*—Lloyd A. Gall

[57] ABSTRACT

The present invention provides a door lock assembly and method which will provide security for building owners and dwellers and will result in a reduction of property damage and loss by burglars. The door lock assembly includes a tumbler type cylinder which can be rotated by a key from the outside to lock a door or other closure to which it is fitted to a first position whereupon the handle inside the door cannot be used to unlatch the lock from the inside. Also, the door can be locked and thereafter the cylinder can be rotated by turning the key in the reverse direction whereupon the door remains locked but upon withdrawing the key the door can be opened from the inside with the handle. Thus, after locking, the key can be withdrawn in either of two cylindrical positions depending on whether the user wants the door to be able to be opened from the inside by use of the handle.

6 Claims, 9 Drawing Figures

20
25
40
41
45
30
31
32
33
34
35
36
37
38
39
42
43
44
46
47
48
49
50
51
52

PATIO SLIDING DOOR LOCK ASSEMBLY AND METHOD

This is a continuation of application Ser. No. 366,762, filed Apr. 8, 1982, now abandoned.

BACKGROUND AND OBJECTIVES OF THE INVENTION

Apartment dwellers, homeowners and others have long been plagued by the inconveniences and lack of security afforded by conventional sliding glass doors. The sliding doors, commonly referred to as "patio doors" are generally light weight structures which have aluminum frame channels in which they slide. Conventional cylinder locks are employed and oftentimes a night latch, dead bolt or door chains are employed from inside to provide additional locking ability. However, the locking mechanisms used to date have not been entirely satisfactory under particular circumstances and the present invention was developed in order to provide a more burglar-proof structure than is presently available.

Another objective of the present invention is to provide a cylinder lock assembly which allows the user to lock or unlock the door from the outside and permits a choice of key withdrawal or locking positions.

It is still another objective of the present invention to provide a locking apparatus having an inside handle which cannot be used to unlock the door with the key withdrawn in a first locking position and whereby the handle can be used to unlock the door if the key is withdrawn from the lock in a second locking position.

It is still another objective of the present invention to provide a door assembly which includes a vertical motion stop means to prevent the door from being pried upwardly and out of its lower channel by burglars or the like.

It is still yet another objective of the present invention to provide a method of securing a door which includes rotating the cylinder means of the locking apparatus in such a direction or directions whereby the user can elect whether to permit the door to be unlocked from the inside by use of the handle.

Other objectives and advantages of the present invention will become clear as the present invention is explained further hereinafter.

DESCRIPTION OF THE PREFERRED EMBODIMENTS

The preferred form of the lock assembly of the present invention includes a key operated cylinder means which is joined to a cam wheel means having a lug member. The lug member is rotatably positioned within an arcuate slot of a latch member which is affixed to a rotatable handle. The arcuate slot is approximately semi-circular in configuration and the lug member, upon reaching either end of the arcuate slot forces the latch member and affixed handle to rotate. A catch member is rigidly positioned on a door jamb whereby the latch member can be engaged with the catch means to lock the door.

The preferred form of the locking apparatus includes a door means having a catch means recess whereby said door means can engulf the catch means when the door means is closed. The engulfment of the catch means by the recess in the door means helps to prevent the door means from being pried upward out of its lower track by a burglar.

The preferred method of securing a door means as shown herein comprises closing the door means and thereafter rotating the cylinder means of the lock assembly with a key in a first direction whereby the catch means will engage the latch means and thereafter rotating the cylinder means in an opposite direction while maintaining engagement of the latch means with the catch means so as to enable someone inside the house or apartment, if they should so desire, to use the handle means which is affixed to the latch means to disengage the latch means from the catch means in order to open the door means.

A preferred door assembly of the present invention includes upper and lower frame members and front and back vertical support members which form a substantially rectangular shaped door means. The door means is fitted within upper and lower track means in which it slides and within the upper track means is positioned a vertical action stop means to prevent upward vertical motion of the door means, for example should a burglar try to pry the door upward and away from the lower track means in an effort to gain entry through the door means.

SUMMARY OF THE INVENTION

The invention contained herein includes a door lock assembly and method whereby a key can be used on the outside of the door means to unlock the door means or to lock it with the key being withdrawn in either of the two positions. The first position in which the cylinder means can be left by so withdrawing the key allows a spouse or other person who is left inside to unlock the door by turning the handle member. In the alternative, the key can be withdrawn in a second position by so turning the cylinder means whereby the handle member on the inside is rigidly positioned thus preventing anyone inside or one reaching inside from unlocking the door by turning the handle.

Additionally, the door means which incorporates the lock assembly includes a recess for engulfing the catch means which is positioned on the door jamb, when the door is closed. This engulfing action prevents or assists in preventing burglars or others from placing a prying tool under the bottom of the door means and forcing it upward and out of its lower track to thereby gain entry. Also, a vertical motion stop means is available for positioning in the upper track means which will also reduce the possibility of the door means being pried upward and out of the lower track means.

Figure 1:
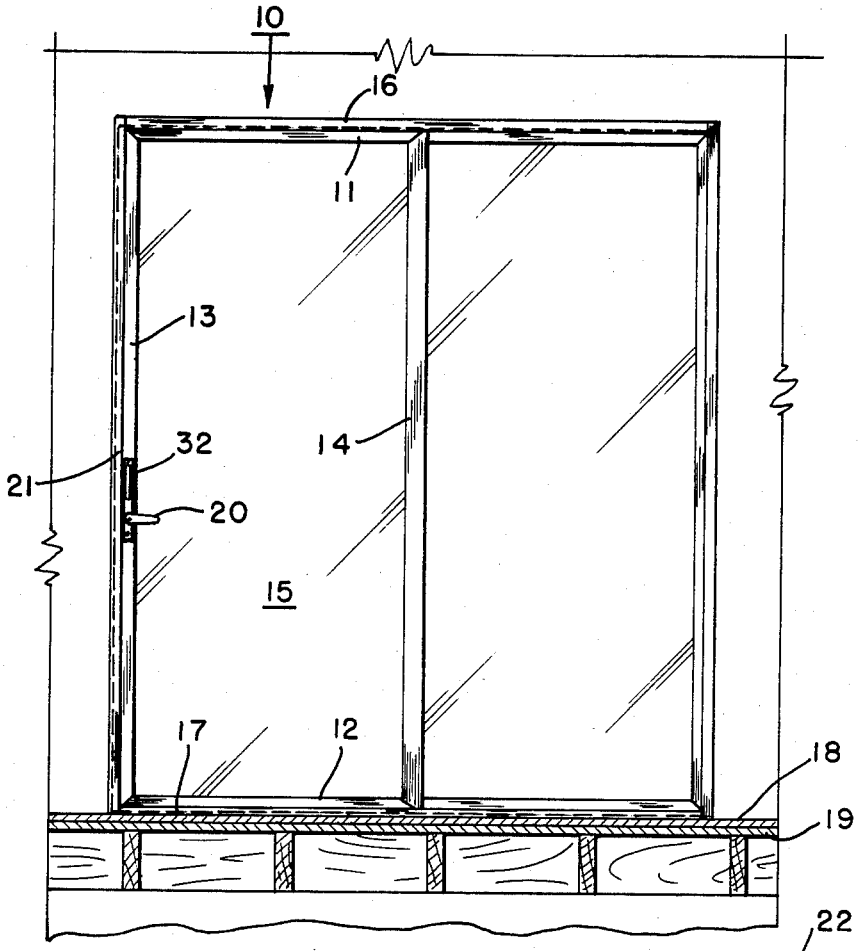
FIG. 1 is a typical installation of a sliding door means utilizing the present invention.

For a more detailed description of the drawings, FIG. 1 demonstrates a typical sliding door means 10 having an upper frame member 11, a lower frame member 12, a front vertical support member 13 and a rear vertical support member 14. Glass panel 15 which is rectangular in shape is contained within the vertical support members 13 and 14 and frame members 11 and 12. Door means 10 is slidably positioned within upper track means 16 and lower track means 17. Lower track means 17 is shown on flooring 18 which may be wood flooring or the like which in a typical installation would be placed over subflooring 19 in a typical cross-sectional flooring construction as shown in FIG. 1.

Handle member 20 in FIG. 1 is in a horizontal or latched position although as would be understood handle member 20 could be positioned in various ways relative to the latch member (not shown) which engages catch members (not shown) that is affixed to door jamb 21.

Figure 2:
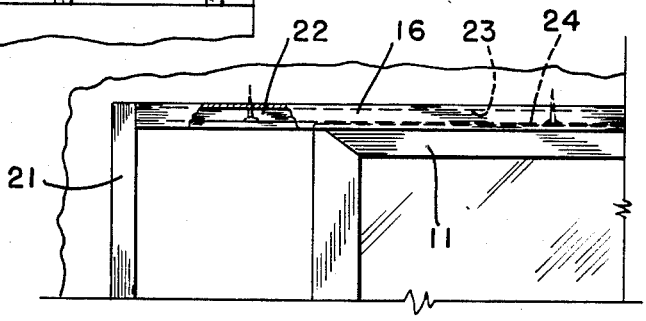
FIG. 2 is an enlarged top section of the door means as shown in FIG. 1.

Upper track means 16 and lower track means 17 may be substantially U-shaped aluminum extrusions which provide a slidable fit for door means 10. Oftentimes during the installation or construction of sliding doors a gap remains between the top of upper frame member 11 and the inner top surface of upper track means 16. Consequently, burglars have been known to insert prying tools into the lower track means and by supplying sufficient force lift the door means upwardly, out of the lower track means and then pull it out of the upper track means and gain entry into the house or apartment. Thus, in order to reduce this type of forced entry, a vertical motion stop means 22 can be placed in upper track means 16 as shown in FIG. 2 to reduce the space between the inside upper surface 23 of upper track means 16 and top surface 24 of upper frame member 11.

Figure 3:
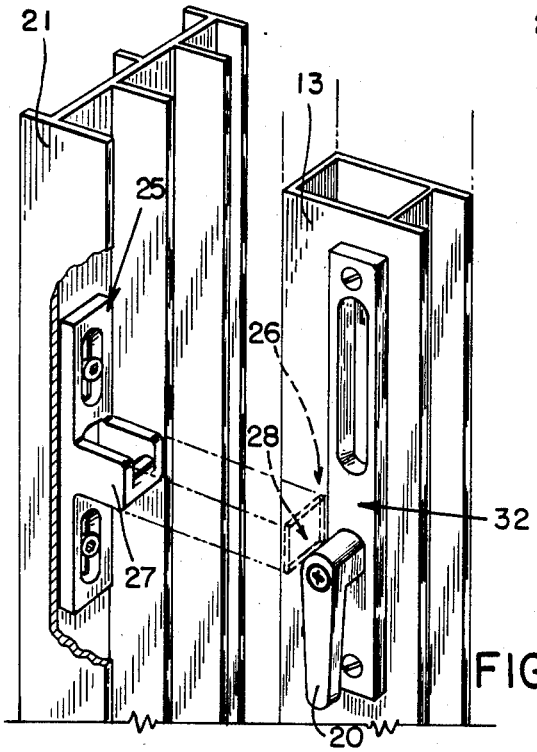
FIG. 3 is a schematic view of a segment of the door means and door jamb.

Along with vertical motion stop means 22, catch means 25 as shown in FIG. 3 aids in preventing door means 10 from being pried upward as front vertical support means 13 includes a catch means recess 26 into which catch means latch lug 27 fits by passing through support member opening 28 when door means 10 is closed.

Figure 4:
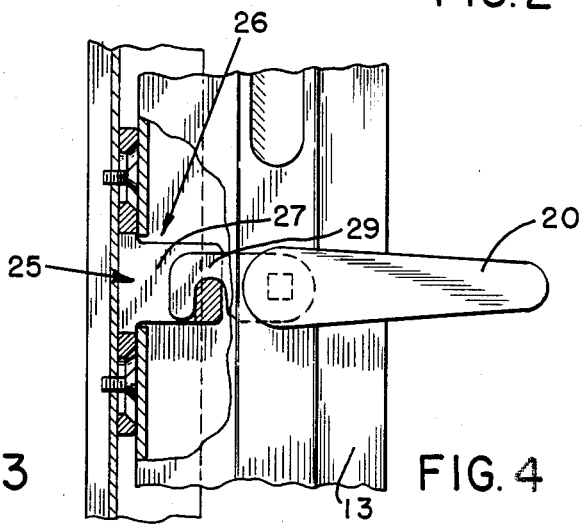
FIG. 4 demonstrates in cross-sectional cut-away fashion the locking engagement of the invention.

In FIG. 4 latch member 29 is shown in locked engagement with catch means 25 with catch means latch lug 27 engulfed by catch means recess 26 and as would be understood, front vertical support member 13 would be prevented from moving upwardly by prying or otherwise as catch means latch lug 27 is tightly engulfed in catch means recess 26.

Figures 5, 6A, 6B, 6C:
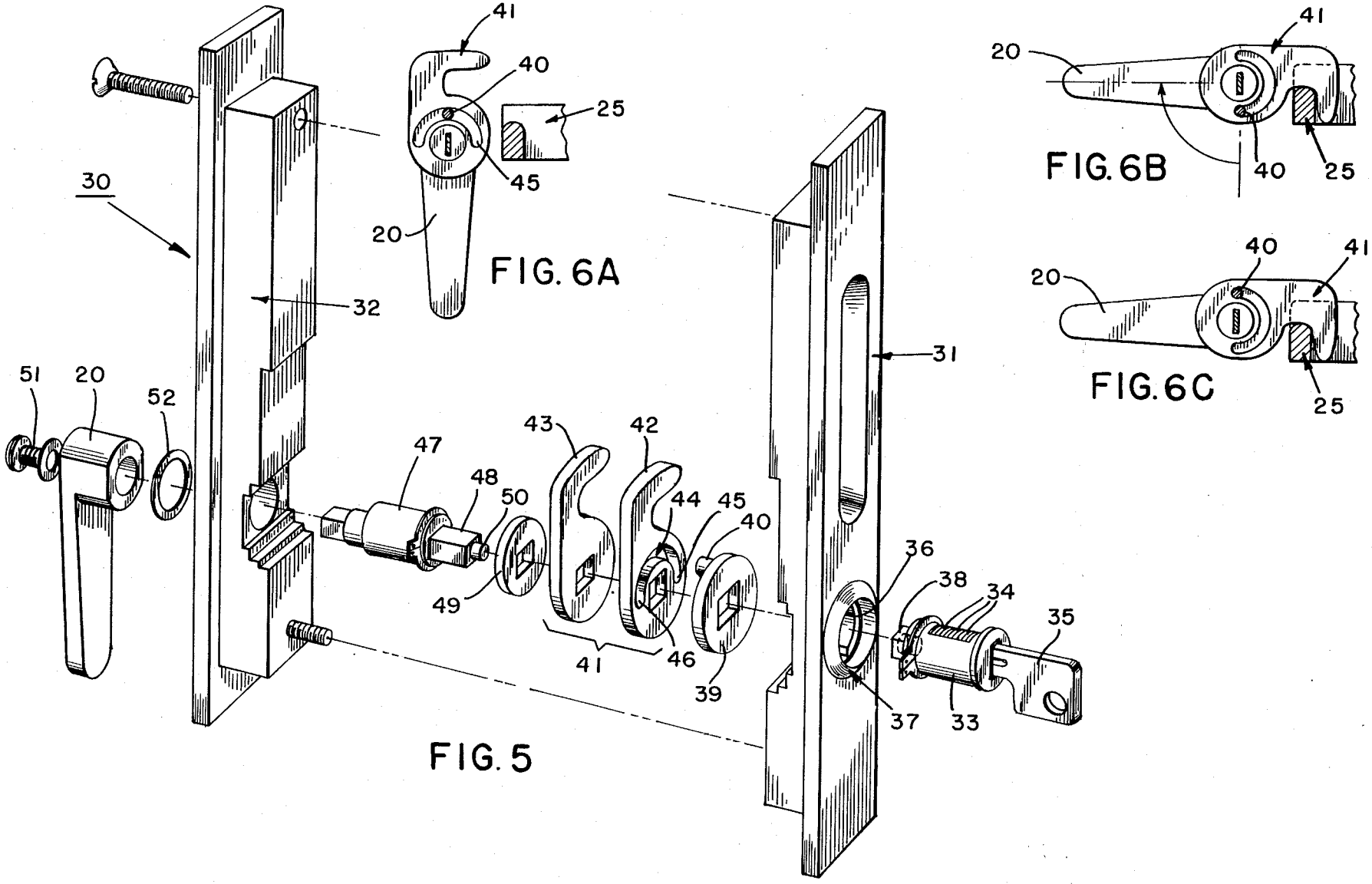
FIG. 5 is an exploded view of the lock assembly of the present invention.
FIG. 6*a* demonstrates the relative positions of the latch member and catch means in disengaged fashion.
FIG. 6*b* illustrates the latch member rotated 90° from that shown in FIG. 6*a* and engaged with the catch means.
FIG. 6*c* illustrates the lug member of the cam wheel means rotated counter-clockwise 180° from the position shown in FIG. 6*b.

An exploded view of lock assembly 30 is shown in FIG. 5 and includes outer support insert 31 and inner support insert 32 which are positioned on each side of vertical support member 13 when lock assembly 30 is in operation. A typical rotatable cylinder means 33 having a series of tumbler elements 34 is fitted within outer support insert 31 and is rotatably controlled by key means 35. As would be understood key means 35 in a typical installation would be generally for the outside locking of a patio or back door.

Tumbler elements 34 in FIG. 5 are spring loaded whereby said elements are urged out and away from the outer surface of cylinder means 33 when key means 35 is extracted. To accommodate this outward movement of tumbler elements 34 inner cylinder wall 36 includes upper groove means (not shown) and lower groove means 37. Thus, key means 35 can be inserted in cylinder means 33 for rotation whereupon, tumbler elements 34 are extended prior to insertion and insertion of key means 35 causes elements 34 to withdraw to a substantially flush posture with the outer surface of cylinder means 33. Key means 35 cannot be withdrawn except when tumbler elements 34 have the capacity to protrude or extend from cylinder means 33, i.e. with tumbler elements 34 aligned with one of the groove means of inner cylinder wall 36. Therefore, by providing two groove means, key means 35 can be withdrawn in either of two aligned positions of cylinder means 33.

Cylinder means 33 also includes a substantially square shaped shoulder stud 38 upon which cam wheel means 39 is positioned. Cam wheel means 39 includes lug means 40 which drives latch member 41 shown in two halves in FIG. 5, although latch member 41 may be produced as only one part. As would be understood lug means 40 is slidably received in arcuately shaped slot means 44 of latch member right half 42 and if cylinder means 33 were rotating in a clockwise direction, when lug means 40 reached right slot end 45 latch member 41 would, upon continual clockwise rotation of cylinder means 33, also rotate in a clockwise direction. Conversely, if cylinder means 33 were rotated in a counter-clockwise direction, when lug means 40 contacted left slot end 46 of slot means 44, upon continuing counter-clockwise rotation of cylinder means 33, latch means 41 would rotate in a counter-clockwise direction.

Handle shaft 47 includes shaft extension means 48 upon which spacer 49, and latch member 41 are situated. Axle member 50 fits within shoulder stud 38 when lock assembly 30 is united with handle member 20 joined to handle shaft 47 by securing member 51 which is threadably received by handle shaft 47. Washer 52 which abuts handle member 20 is also shown in FIG. 5.

As would be understood, key means 35 when inserted into cylinder means 33 positioned as shown in FIG. 5, has lug member 40 positioned at the zenith of its rotation, also as shown in FIG. 6*a*, with handle member 20 pointing vertically downward. When key means 35 is then rotated 90° clockwise, lug means 40 contacts right slot end 45 and additional clockwise rotation of key means 35 causes latch member 41 to rotate also in a clockwise direction until latch member 41 fully engages catch means 25 as shown in FIG. 6*b* whereupon lug means 40 is at the bottom of its rotational travel. Handle member 20 as shown in FIG. 6*b* is now at a substantially horizontal position.

If key means 35 were withdrawn from cylinder means 33 positioned in FIG. 6*b*, handle member 20 could not be rotated, and therefore the door means could not be opened from the inside by using handle member 20 with lug member 40 so positioned.

Figure 6D:
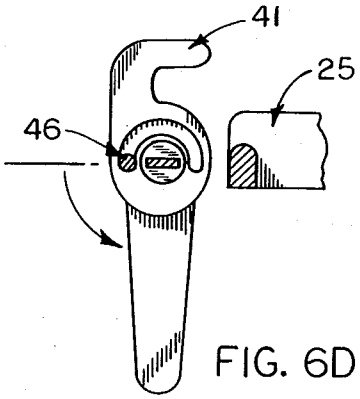
* and FIG. 6*d* illustrates the lug member rotated counter-clockwise an additional 90° from that as shown in FIG. 6*c;*

If it were desirable to allow the door means to be opened from the inside by unlatching the lock assembly 30 by use of handle member 20, then key means 35 should be rotated in a counter-clockwise direction so lug member 40 would travel from the positions shown in FIG. 6*b* to the position shown in FIG. 6*c* with key means 35 being withdrawn from cylinder means 33. As it would be understood from FIG. 6*c*, handle member 20 could be rotated in a counter-clockwise direction whereby latch member 41 would disengage catch means 25 so the door means could then be opened. In the alternative, if it were desirable to unlock the door from the outside by the use of key means 35, then the key means would be inserted into cylinder means 33 and cylinder means 33 rotated in a counter-clockwise direction whereupon lug member 40 would contact the left slot end 46 of arcuately shaped slot means 44 whereupon further counter-clockwise rotation of key means 35 would urge latch member 41 to disengage catch means 25 as shown in FIG. 6*d*. As therefore shown, the invention affords a method of securing a door means whereby the cylinder means is rotated in a first direction by the use of a key means whereby the latch member engages the catch means and by then rotating the cylinder means in a direction opposite to the first direction the latch member is maintained in engagement with the catch means but the handle member is rotatable from the inside to disengage the latch member as required.

Various modifications and changes can be made to the invention and the relative positions of the components can be altered, if desired. The examples and illustrations shown herein are merely for demonstrative purposes and they are not intended to limit the scope of the invention.

I claim:

1. A key operated lock assembly for a patio sliding door having first and second locking positions for engaging a catch means comprising: a cylinder means, a cam wheel means, said cam wheel means including a lug member, said cam wheel means joined to said cylinder means, said cylinder means defining a key receiving slot, a latch member, said latch member for engaging said catch means, said latch member having a semi-circular lug slot, said lug member slidably received in said semi-circular lug slot, an independent rotatable handle member, said handle member rigidly joined to a shaft, said shaft joined to said latch member for rotation therewith, said cylinder means including a tumbler element and a shoulder stud, a first support means, said cylinder means mounted on said first support means, said first support means defining a plurality of tumbler receiving grooves, said shaft having an extension means, said extension means including an axle member, said shoulder stud receiving said axle member, said cylinder means being rotatable to a first locking position by a key for moving said lug member to one end of said semi-circular slot urging said latch member into engagement with the catch means whereat said handle member cannot be rotated and said cylinder means being rotatable to a second locking position by a key for moving said lug member to said other end of said semi-circular slot whereat said handle member can be rotated to disengage said latch member from said catch means.

2. A key operated lock assembly as claimed in claim 1 wherein said latch member comprises first and second latch portions, said first and second latch portions having substantially identical outer configurations, said second latch portion having a semi-circular lug slot therein, said first and second latch portions having rectangular-shaped openings for positioning in side-by-side relationship on said extension means.

3. A key operated lock assembly as claimed in claim 1 wherein said handle member, said latch member and said cylinder means are all in axial alignment.

4. A key operated lock assembly as claimed in claim 1 and incuding a securing member, said securing member for rigidly joining said handle member to said shaft.

5. A key operated lock assembly as claimed in claim 1 wherein said shaft includes a rectangular-shaped end portion and a cylindrically shaped body portion.

6. A key operated lock assembly as claimed in claim 5 and including a second support means, said shaft rotatably positioned in said second support means.

* * * * *